United States Patent [19]

Hrebar

[11] 3,961,423

[45] June 8, 1976

[54] SECONDARY SIDE MOUNTED GUN SIGHT AND ARRANGEMENT, FOR AUXILIARY USE WITH A PRIMARY TOP MOUNTED TELESCOPE RIFLE SIGHT

[76] Inventor: Matthew J. Hrebar, P.O. Box C, Beaverdale, Pa. 15921

[22] Filed: Feb. 18, 1975

[21] Appl. No.: 550,424

[52] U.S. Cl. ..... 33/258; 33/245; 33/261

[51] Int. Cl.[2] ..... F41G 1/02; F41G 1/16; F41G 1/38; F41G 11/00

[58] Field of Search ..... 33/245, 246, 247, 248, 33/249, 250, 252, 254, 255, 256, 257, 258, 261

[56] References Cited

UNITED STATES PATENTS

| | | | |
|---|---|---|---|
| 1,000,145 | 8/1911 | Bennett | 33/245 |
| 1,911,770 | 5/1933 | Redfield | 33/258 |
| 2,054,090 | 9/1936 | Marple | 33/245 |
| 2,585,345 | 2/1952 | Procos | 33/252 |
| 3,165,836 | 1/1965 | Magardo | 33/257 |
| 3,270,418 | 9/1966 | Simeone et al. | 33/258 |

*Primary Examiner*—Richard E. Aegerter
*Assistant Examiner*—Steven L. Stephan

[57] ABSTRACT

This invention is a secondary sighting system to supplement a primary telescopic sight on a rifle. It consists of a pair of sights, one front and one rear, which are off-set to the side of the rifle bore, in a position which allows their instant use, should the primary telescopic sight become inoperable because of internal fogging, snow or rain covered lenses, target moving fast in thick brush, or target being too close to permit proper vision and sighting with scope magnification.

The front sight is a bead type, mounted on a support bar extending to the side from the gun barrel. The rear sight is an open notch type or a peep aperture, or both at one time, mounted on the side of the gun breech. This pair of sights permits a second line of sight aside from the telescope line of sight, parallel to the rifle bore.

The front sight bead support bar is approximately one inch long. It is wedged into the dovetail sight support slot near the rifle muzzle, and extends approximately one-half inch to the side of the barrel. Bullet impact to the left or right is controlled by moving the front sight bead to right or left when the support bar is shifted left or right in the barrel slot.

The rear sight notch, or peep aperture, is mounted on a support plate fastened to the side of the breech, which can be shifted up or down to control bullet impact up or down.

The shooter uses the dual sighted rifle as a telescope sighted gun under all possible shooting conditions. The secondary sights are used when the primary telescopic sight becomes inoperable.

2 Claims, 14 Drawing Figures

FIG. 1
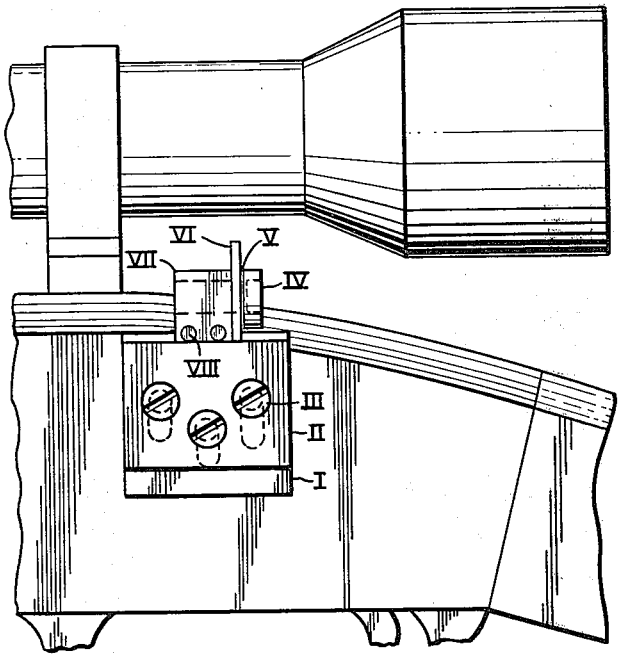
FIG. 2
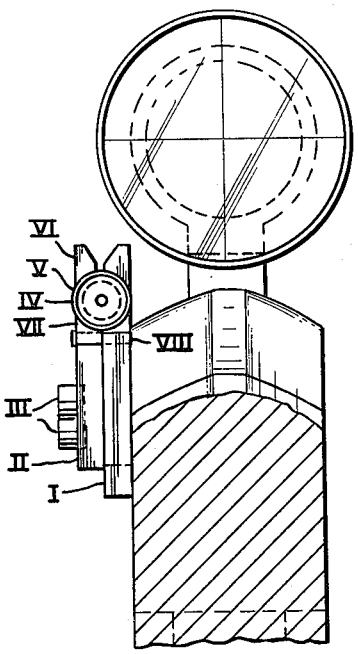
FIG. 3
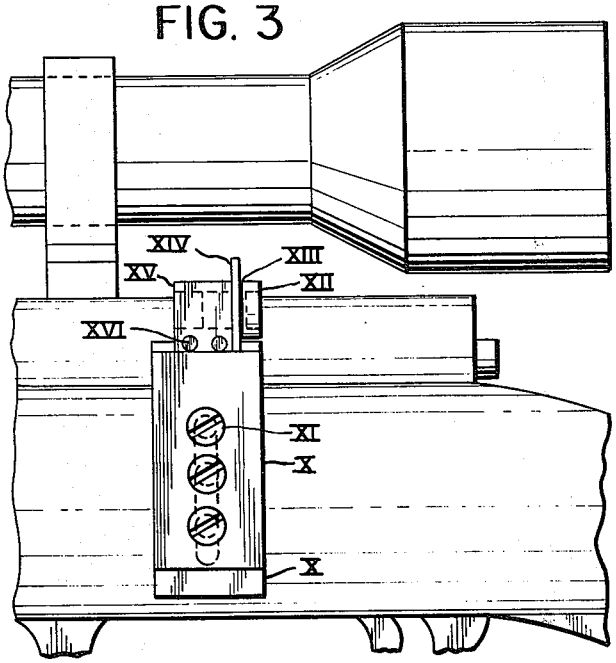
FIG. 4
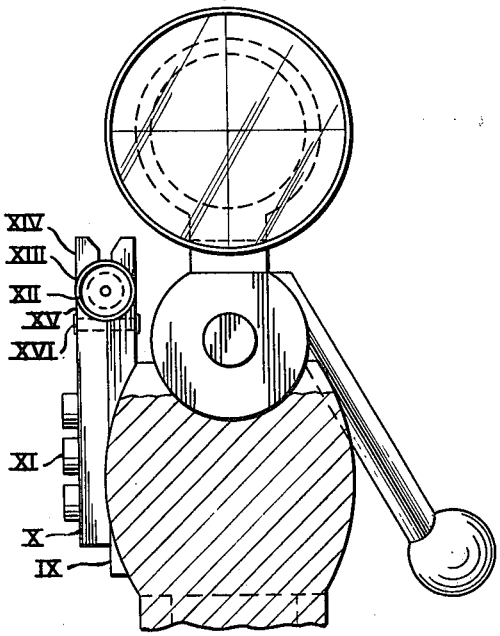
FIG. 5
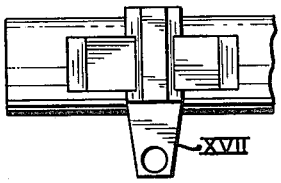
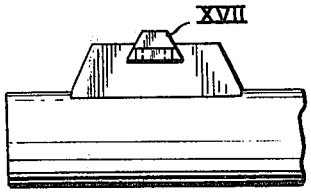
FIG. 6
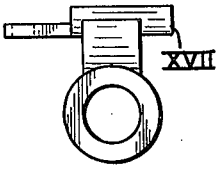
FIG. 7

FIG. 8
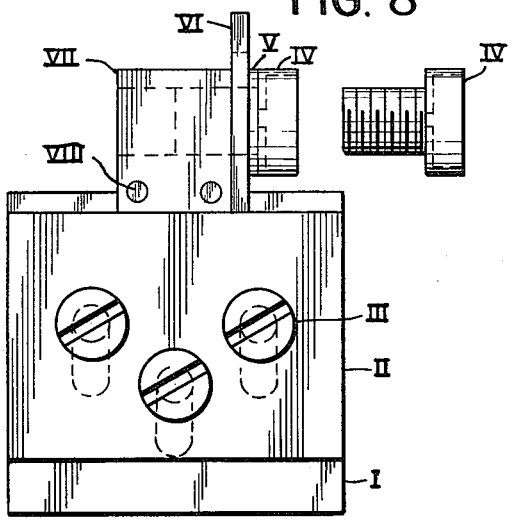
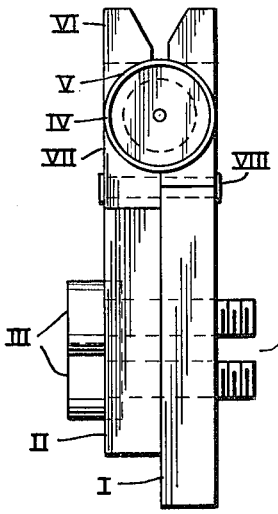
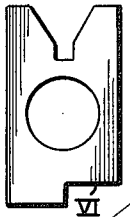
FIG. 9
FIG. 10
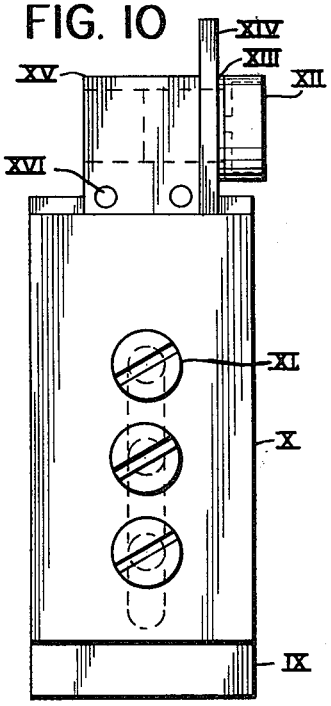
FIG. 11
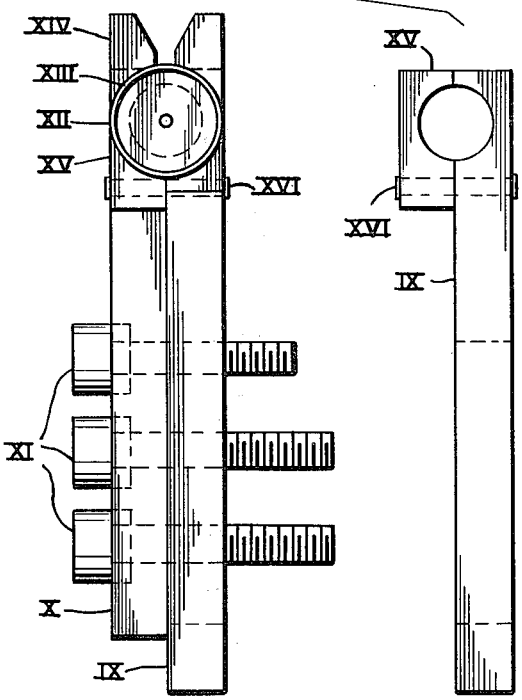
FIG. 12
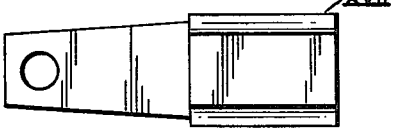
FIG. 13
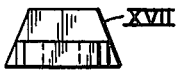
FIG. 14
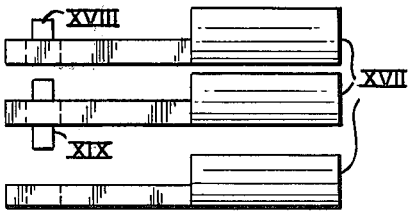

SECONDARY SIDE MOUNTED GUN SIGHT AND ARRANGEMENT, FOR AUXILIARY USE WITH A PRIMARY TOP MOUNTED TELESCOPE RIFLE SIGHT

SUMMARY OF THE INVENTION

Experience in big game hunting with telescopic gun sights has proven a need for equipping ones rifle with a second set of sights for use when the primary telescopic sight becomes inoperable. While in the field, telescopic sights often beome useless because of damage, misalignment, internal lens fogging, lenses becoming covered with snow or rain, target moving fast in thick brush, or target being too close for proper vision and sighting because of magnification.

Several methods of secondary sighting have been devised to overcome these telescope sight weaknesses. Through the years I have purchased and tested all of the auxiliary sighting systems which have come to my attention, and have found them wanting. I found the systems to be undesirable chiefly because of adverse effect upon the primary telescopic sighting system, which is the one used for the vast majority of shots. I found these second sighting systems sacrificed sturdiness of primary telescope mounting with subsequent loss of scope alignment during shooting and handling, and they caused rifle unbalance affecting holding and sighting.

I have tested four methods of secondary sighting with a scope equipped rifle:

First I tried a quick detachable scope mount. This method permitted removal of the scope in the field if it became damaged, fogged, or out of line, and allowed the use of open sights located beneath the scope on top of the rifle barrel. This method did nothing to help in the more frequent moments of need when lenses were snow or rain covered, or the target was moving fast in brush, or the target was too close for scope use. In addition the gun seldom shot in the same place after replacing the scope.

Second I tried a side mounted scope with open and with peep sights over the top center of the barrel. This method proved awkard for holding and sighting, and extra long shooting could not be done accurately.

Third I tried a swing type scope mount which permited swiveling the primary top mounted scope sight away to the side, allowing use of top of the barrel open sights. This method was not satisfactory because the swivel action was difficult to perform under the stress of field action. In addition my rifle did not group well at long range, and it never impacted in the same spot after the scope was pivoted to the side amd returned to shooting position.

Fourth I tried a see-thru scope mounting arrangement which permits mounting the scope high above the barrel on a boxlike support which allows use of open or peep sights mounted beneath the scope. This method proved unsatisfactory to me as the scope was mounted too high for efficient holding and comfortable aiming. With this scope sight my rifle grouped very poorly, and during shipment is a good quality gun case the scope would twist so as to shoot off to one side as much as ten inches at 100 yards.

The experience gained using the above described systems prompted me to design the method of secondary sighting, which is the subject of this invention application. I have constructed and tested these sights and find them quite satisfactory. They allow:

1. Mounting the primary telescopic sight in a low position directly over the rifle bore with the best rugged scope mounts available.
2. The secondary sights may be open sights, peep sights, or shooter's choice of either at the instant of shooting.
3. They are available for use the instant that the shooter discovers that the telescopic primary sight is inoperable.
4. They have no adverse effect upon gun holding or sighting through the scope.
5. When using the secondary sights the gun can be held in a near normal position with the cheek against the stock.
6. The secondary sights are simple, light, rugged, and easy to install.
7. The rear sight is mounted in a protected, out of the way position.
8. The secondary sights are easily sighted in. They may be placed very near to the proper line before shooting, by positioning them in accordance with the desired bullet impact point as seen through the scope sight. Final positioning is accomplished during shooting by simply tapping the front sight support bar left or right, and the rear sight up or down.
9. Offsetting of the secondary sight line from the rifle bore has very little effect upon accuracy. The sight line may be set parallel to the bore with less than one inch loss in accuracy to one side of the aiming point at all ranges. Greater accuracy may be obtained over a two hundred yard working range by sighting in horizontally at 100 yards.
10. A minor fault with this system is that the front sight assembly protrudes approximately one-half inch from the side of the barrel. This extension however provides better visibility around the target, and also enables the shooter to better judge holding the gun a a vertical position.

DESCRIPTION OF DRAWING VIEWS

Attached to this report are two sheets of drawings. Sheet No. 1 contains seven views numbered 1 to 7 which are drawn actual size, and which illustrate the construction and gun positioning of the front and rear sights. Sheet No. 2 also contains seven views which are numbered 8 to 14; they are drawn twice actual size, and they illustrate construction details of the front and rear sight assemblies.

Drawing Sheet No. 1

FIG. No. 1 (Side Elevation)

This view shows the rear sight assembly mounted on the metal side of the breech of a lever action, pump action, or automatic action rifle, on which is also mounted a primary top telescope sight.

FIG. No. 2 (Rear Elevation)

This view shows the rear sight assembly mounted on the breech of a primary scope mounted lever action, pump action, or automatic action rifle.

FIG. No. 3 (Side Elevation)

This view shows a modified rear sight assembly mounted on the wood side of a top scope sighted bolt action rifle having a one piece stock forepiece.

FIG. No. 4 (Rear Elevation)

This view shows the modified rear sight assembly mounted on the wood side of a top scope sighted bolt action rifle.

FIG. No. 5 (Plan View)

This view shows the top of the front sight bead support bar wedged into a dovetail slot on top of the rifle muzzle and extending to the side. The threaded hole which receives the sight bead is visible.

FIG. No. 6 (Side Elevation)

This view shows the muzzle end of the rifle barrel, the bore line, the dovetail wedge slot, and the end of the front sight bead support bar.

FIG. No. 7 (Rear Elevation)

This view shows the front sight support bar mounted in the rifle barrel wedge slot from the rear.

DRAWING SHEET NO. 2

FIG. No. 8 (Side Elevation)

This view shows the details of the rear sight assembly for mounting on the metal breech side of lever action, pump action, and automatic action type rifles. Also shown in brackets is Element No. IV, which is a threaded peep sight aperture.

FIG. No. 9 (End Elevation)

This view shows the details of the rear sight assembly for mounting on the metal breech side of lever action, pump action and automatic action type rifles. Also shown enclosed in brackets is Element No. VI, which is a flat, notched open sight leaf.

FIG. No. 10 (Side Elevation)

This view shows a modified rear sight assembly for mounting on the wood side of a bolt action type rifle having a one piece wood stock forepiece.

FIG. No. 11 (End Elevation)

This view shows a modified rear sight assembly for mounting on the wood side of a bolt action type rifle having a one piece wood stock forepiece. Also shown enclosed in brackets is a sub-assembly consisting of Elements Nos. XV, XVI, and IX, which is the portion of the rear sight which supports the peep aperture and the notched open sight leaf.

FIG. No. 12 (Plan View)

This view shows the top of the front sight bead support bar.

FIG. No. 13 (End View)

This view shows the bead end of the front sight bead support bar.

FIG. No. 14 (Side Elevations)

This figure shows three side views of the front sight bead support bar which is Element NO. XVII. The top drawing shows the bar equipped with a single sight bead which is Element No. XVIII. The center drawing shows the support bar equipped with a dual sight bed which is Element No. XIX. The lower drawing shows the support bar without sight beads.

DETAILED DESCRIPTION

The purpose of this invention is to provide a second means of sighting a rifle when the first means is a telescopic sight mounted solidly, and as low as practically possible over the top of the rifle.

This purpose is accomplished by installing two sighting devices, one at the muzzle end of the rifle to one side of the rifle bore, and one at the breech end of the rifle to the side of the rifle bore.

The sighting points of the two devices are a bead as a front sight near the muzzle end of the rifle, and a notch or an aperture near the breech end of the rifle. The front and rear sighting points are positioned to the side of the rifle barrel so that they are visible below and to the side of the top mounted telescope. The front and rear sighting points are set on a line parallel or nearly parallel to the rifle bore.

To function, these devices must be fastened firmly to the rifle; provide two sighting points to project a straight line of sight; and they must be adjustable to bring the line of sight and the line of bullet flight into satisfactory coincidence with the target.

The inventor has designed the front and rear sighting devices described in the following as simply as practical to fit a maximum number of standard gun types. The front device is for mounting on any barrel slotted to receive a dovetail wedge front sight. The rear sighting device is shown in two models; one for lever, pump, and automatic action rifles; and one for bolt action rifles having a one piece wood stock forepiece.

The rear sighting device elements for lever, pump, and automatic action rifles are shown in FIGS. 1, 2, 8, and 9. There are eight elements as follows:

I. 3/16 inch × 1⅛ inch × 1 15/32 inch Aluminum Rear Sight Point Support.
II. 3/16 inch × 1⅛ inch × 1 3/16 inch Aluminum Holding Plate.
III. Three ¼ inch Diameter × ½ inch Mounting Cap Screws.
IV. 7/32 inch Diameter Threaded Steel Peep Sight Aperture.
V. ¼ inch Hole Diameter Lockwasher.
VI. Notched Open Sight Leaf.
VII. 3/16 inch × ⅜ inch × 15/32 inch Aluminum Plate
VIII. Two 1/16 inch Diameter × ⅜ inch Rivets.

Element I is cut with three ¼ inch slotted holes to receive the three mounting cap screws Element III. Plate Element VII is riveted to Plate Element I with Rivets Element VIII. This riveted sub-assembly is then bored and threaded to receive the 7/32 inch threaded steel peep sight aperture Element IV. The notched open sight leaf, Element VI, is bolted to the sub-assembly with the threaded Element IV and lock washer Element V. The sub-assembly is reversible, permitting positioning of the rear sighting points 3/16 inch nearer the rifle bore than shown in FIG. No. 2.

The riveted sub-assembly supporting the notched open sight leaf Element VI, and peep sight aperture Element IV, is then fastened to the side of the rifle breech with holding plate Element II, and three cap screws Element III, as shown in FIGS. 1 and 2. The sighting points may be moved up and down by loosening the mounting screws and sliding the sight support sub-assembly in the slots cut in Element I. The holding plate Element II remains in a fixed holding position with the botls, and clamps the sight support sub-assembly in the desired place when the screws are tightened.

The rear sighting device elements for mounting on the wood one piece stock forepiece of bolt action rifles are shown in FIGS. 3, 4, 10 and 11. There are eight elements as follows:

IX. 3/16 inch × ¾ inch × 2 3/32 inch Aluminum Rear Sight Point Support.

X. 3/16 inch × ¾ inch × 1 7/16 inch Aluminum Holding Plate.

XI. Three ¼ inch Wood Cap Screws.

XII. 7/32 inch Diameter Threaded Steep Peep Sight Aperture.

XIII. ¼ inch Hole Diameter Lock Washer.

XIV. Notched Open Sight Leaf.

XV. 3/16 inch × ⅜ inch × 15/32 inch Aluminum Plate.

XVI. Two 1/16 inch Diameter × ⅜ inch Rivets.

This rear sighting device differs from the one previously described only enough to permit mounting on wood in place of metal.

Element IX is cut with one long slot to receive the three mounting wood screws Element XI. Plate Element XV is riveted to plate Element IX with rivets Element XVI. This riveted sub-assembly is then bored and threaded to receive the 7/32 inch diameter threaded steel peep sight aperture Element XII. The notched open sight leaf Element XIV is bolted to the sub-assembly shown enclosed in brackets in FIG. No. 11, with the threaded Element XII and lock washer Element XIII. The sub-assemly is reversible, permitting positioning the rear sighting points 3/16 inch nearer to the rifle bore than shown in FIG. 4.

The riveted sub-assembly supporting the notched open sight leaf Element XIV and peep sight Element XII is then fastened to the side of the rifle stock forepiece near the gun breech with holding plate Element X three wood cap screws Element XI as shown in FIGS. 3 and 4. Before mounting, the wood stock forepiece is filled flat and smooth at the desired rear sight location. The sighting points may be moved up and down by loosening the three wood cap screws, and sliding the sight support sub-assembly in the slot cut in Element IX. The holding plate Element X remains in a fixed position with the wood screws, and clamps the sight support sub-assembly in the desired position when the screws are tightened.

The front sight device fits any rifle having a dovetail wedge slot at the top of the barrel near the muzzle, which is a standard method of holding a front bead sight. Positioning of the front sight is shown in FIGS. 5, 6, and 7. Details of the three elements are shown in FIGS. 12, 13, and 14.

The three elements are as follows:

XVII. Front Sight Bead Support Bar.

XVIII. Front Single Sight Bead.

XIX. Front Dual Sight Bead.

The front sight bead support bar Element XVII is a piece of steel 3/16 inch × ⅜ inch × 1⅛ inch long. It is wedge-shaped on the barrel side, and flat with a ⅛ inch threaded bead hole on the other end. FIG. 12 shows a top view; FIG. 13 shows an end view; and FIG. 14 shows three side views. The support bar Element XVII is tapped into the wedge groove at the top of the rifle barrel, so that the threaded hole extends approximately ½ inch to the side of the barrel. FIG. 5 shows a plan view of Element XVII installed on a rifle barrel. FIG. 6 shows a side elevation, and FIG. 7 shows a rear elevation.

With this secondary sighting system, the shooter has a choice of open notched leaf sights or peep aperture sights. The front sight bead arrangement is dependent upon the shooter's choice. There are three front sighting arrangements. FIG. 14 shows three side views of the bead support bar Element XVII. The upper view shows a top bead element XVIII. The middle view shows a dual bead, top and bottom Element IX. The lower view shows Element XVII without a bead.

These front sight arrangements are used as follows:

1. When open sights only are desired on the rifle, Element XVII is equipped with the single top bead Element XVIII, as shown in the upper view of FIG. 14. In sighting, the open rear notch is lined up with the front top bead in standard fashion.

2. When peep sights only are desired on the rifle, there are two choices of front sighting. The rear peep may be lined with the front bead on top, Element XVIII in in FIG. 14 as with open sights, or the outside edge of the sight support bar Element XVII can be used as the front sighting point by holding to the target from the side. In this second choice, no front bead is required.

3. When both open and peep sights are desired on the rifle for shooter's choice at the moment of firing, the front sight support bar is equipped with the middle view of FIG. 14. When using the open sight at the rear of the rifle, the target is sighted above the top bead of Element XIX, and when using the peep sight at the rear, the target is sighted below the lower bead of Element XIX.

The lower 5/64 inches of the top front beat Element XVIII, as shown in FIG. 14, is threaded to screw into the bead support bar. The dual bead Element XIX, shown in FIG. 14, has 5/64 inches threaded for screwing into the bead support bar in the section, 5/64 inches from the top and 3/32 inches from the bottom.

The front sighting beads, rear peep aperture, and rear open sight may be styled in various forms, as is customary in today's shooting practice. When an open rear sight is desired alone, the open sight leaf may be held with a threaded screw in place of the threaded peep aperture as shown in the drawings.

The inventor claims that he has designed and constructed a system for accurately aiming a rifle, with a set of front and rear sighting points offset to the side of the rifle bore, while the rifle is equipped with a telescope primary sight mounted on top of the rifle breech and barrel obscuring sight between the bottom of the telescope sight and the top of the barrel. This system consists of a front sight assembly and a rear sight assembly.

I claim:

1. A gun sight comprising: a front sight assembly, said front sight assembly including a support means mounted on one side of a gun with a front sighting element thereon, said front sighting element being supported by said support means to one side of the gun; a rear sight assembly, said rear sight assembly including a support plate having at least one slot therein, a clamp means having fastening means extending through said slot and fastening said clamp means to said one side of the gun to clamp the support plate to said one side, said slot extending in the vertical direction a sufficient distance to allow vertical adjustment of said support plate, said support plate mounting both a peep sight aperture and an open sight in positons on said one side of the gun so that either may be used by a shooter.

2. A gun sight as recited in claim 1 wherein the front sight assembly support means includes; a front sight ramp located on the front end of the gun with a generally horizontal transverse dovetailed slot therethrough, and a transverse bar shaped to fit tightly in said transverse slot and be slidable therein for horizontal adjustment for windage, and also to extend on said one side of said gun and support said front sighting element.

* * * * *